US005498927A

United States Patent [19]

Vervecken et al.

[11] Patent Number: 5,498,927

[45] Date of Patent: Mar. 12, 1996

[54] LOW-PRESSURE SODIUM DISCHARGE LAMP HAVING SEALED CURRENT CONDUCTORS WITH FIRST AND SECOND GLASS COATING

[75] Inventors: Karel R. Vervecken, Turnhout, Belgium; Petrus M. G. Van Gennip, Eindhoven, Netherlands

[73] Assignee: U.S. Philips Corporation, New York, N.Y.

[21] Appl. No.: 233,907

[22] Filed: Apr. 28, 1994

[30] Foreign Application Priority Data

May 3, 1993 [EP] European Pat. Off. ..... 93201256

[51] Int. Cl.[6] ..... H01J 17/18

[52] U.S. Cl. ..... 313/623; 313/624; 313/626

[58] Field of Search ..... 313/623, 624, 313/626

[56] References Cited

U.S. PATENT DOCUMENTS

| | | | |
|---|---|---|---|
| 3,742,283 | 6/1973 | Loughridge | 313/623 |
| 4,691,142 | 9/1987 | Dohmen | 313/623 |
| 4,783,612 | 11/1988 | Sprengers | 313/331 |

*Primary Examiner*—Sandra L. O'Shea
*Assistant Examiner*—Vip Patel
*Attorney, Agent, or Firm*—Brian J. Wieghaus

[57] ABSTRACT

In the low-pressure sodium discharge lamp the current conductors (3) have a first (4) and a second glass coating (6). The first coating (5) of borate glass extends from inside the discharge vessel (1) through a pinch seal (4). The second coating (6) of lime glass envelopes the first one (5) within the pinch seal (4) and extends to outside the discharge vessel (4). The occurrence of cracks in the pinch seal is thereby obviated.

11 Claims, 1 Drawing Sheet

LOW-PRESSURE SODIUM DISCHARGE LAMP HAVING SEALED CURRENT CONDUCTORS WITH FIRST AND SECOND GLASS COATING

BACKGROUND OF THE INVENTION

The invention relates to a low-pressure sodium discharge lamp comprising:

a discharge vessel which is sealed in a vacuumtight manner and has a filling comprising sodium and rare gas;

electrodes arranged in the discharge vessel and each connected to at least one respective current conductor which issues to the exterior through a respective pinched seal, wherein the current conductors each have a first coating of borate glass which extends from within the relevant pinched seal to inside the discharge vessel, and in contact with said coating a second, lime glass coating which extends to outside the discharge vessel;

an evacuated outer bulb which is provided with an IR reflection filter and which surrounds the discharge vessel.

Such a low-pressure sodium discharge lamp is known from U.S. Pat. No. 4,783,612.

In the known lamp, the coatings have a butt joint which lies inside the relevant pinched seal. The first coating is resistant to sodium. This coating protects the current conductors against electric contact with liquid or solid sodium which could deposit against the pinched seal. The discharge arc could apply itself to the sodium if the coating were absent, which would lead to violent reactions and damage to the current conductor and the pinched seal. The second coating is thicker than the first one and absorbs forces which result from the difference between the coefficients of thermal expansion of the discharge vessel and the current conductors.

The construction of the known lamp was found to be reliable in the case of operation at mains frequency. With high-frequency operation, however, cracks arise in the pinched seal after a few thousand hours already, leading to lamp leaks and thus to the end of lamp life.

SUMMARY OF THE INVENTION

It is an object of the invention to provide a low-pressure sodium discharge lamp of the kind described in the opening paragraph which is of a construction which is reliable also in the case of high-frequency operation.

According to the invention, this object is achieved in that the first coating extends through the entire pinched seal and is enveloped by the second coating in the pinched seal.

It is assumed that the damage to the known lamp operated at high frequency is caused by the higher electrical resistance which the current conductors have upon high-frequency operation, because they conduct the current substantially only along their surfaces in that case. The current conductors and the pinch then assume higher temperatures.

It was a surprise to find that the lamp according to the invention can be operated for thousands of hours at high frequency without cracks appearing in the pinched seal.

BRIEF DESCRIPTION OF THE DRAWINGS

An embodiment of the low-pressure sodium discharge lamp according to the invention is shown in the drawing, in which.

DESCRIPTION OF THE PREFERRED EMBODIMENTS

Figure 1:
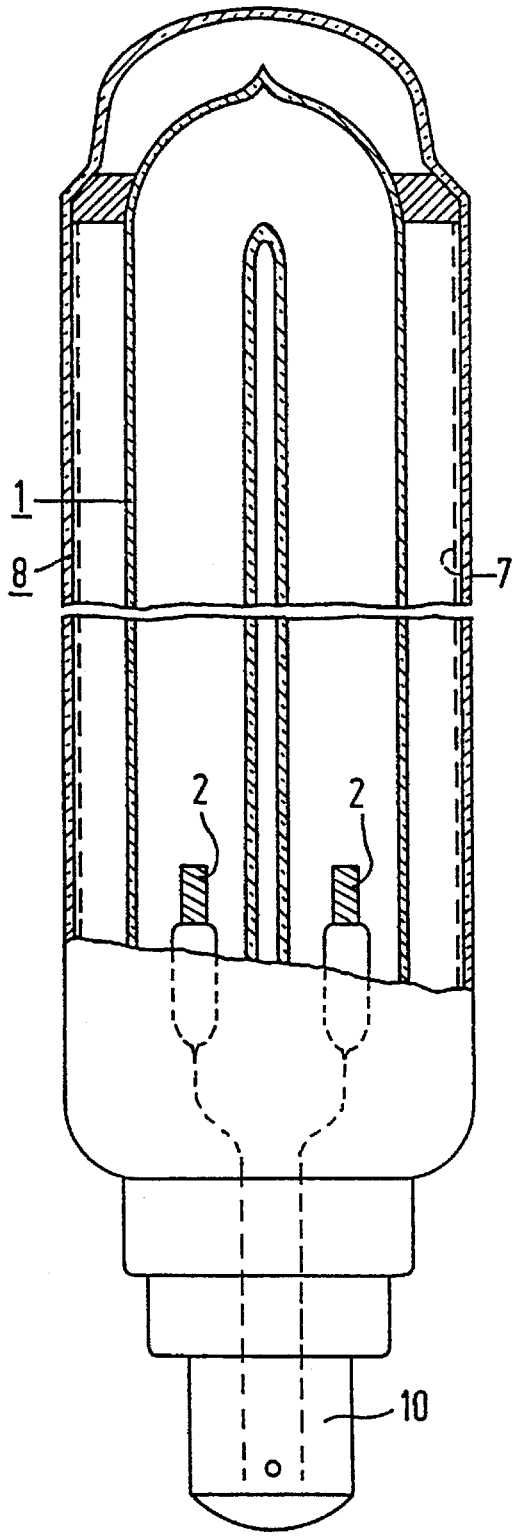
FIG. 1 shows a lamp in side elevation, partly in longitudinal section.
Figure 1A:
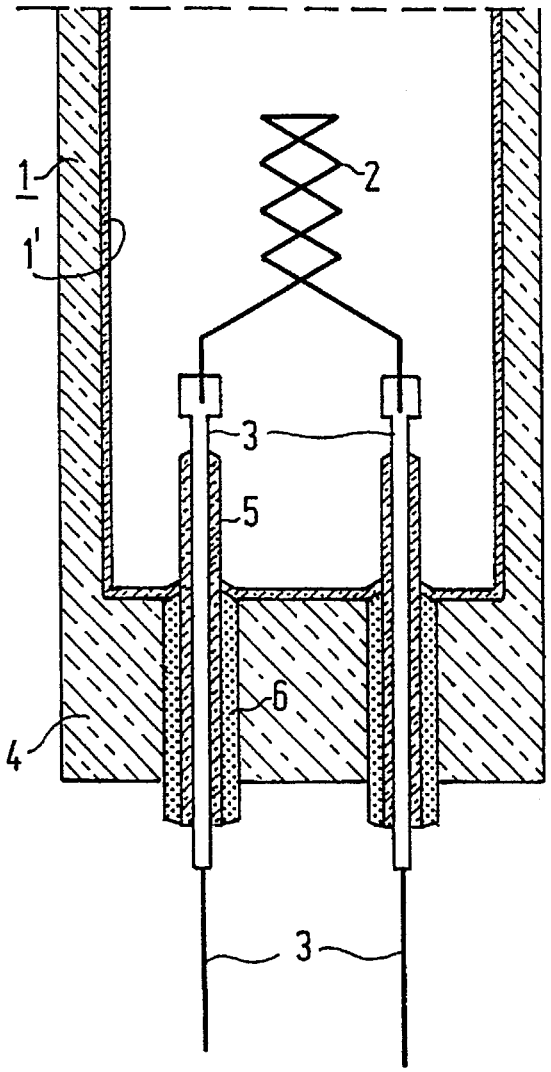
FIG. 1*a* shows a detail from FIG. 1 in cross-section on an enlarged scale.

In the drawing, the low-pressure sodium discharge lamp has a discharge vessel 1 which is sealed in a vacuumtight manner and contains a filling comprising sodium and rare gas.

Electrodes 2 are arranged in the discharge vessel, each connected to at least one respective current conductor 3 which issues to the exterior through a respective pinched seal 4. In the lamp shown, each electrode has two current conductors. The current conductors 3 each have a first coating 5 of borate glass which extends from the relevant pinched seal 4 to inside the discharge vessel 1, and in contact with the said coating 5 a second coating 6 of lime glass which extends to outside the discharge vessel.

An evacutated outer bulb 8 provided with an IR reflection filter 7 surrounds the discharge vessel and carries a lamp cap, for example, a bayonet cap 10.

The first coating 5 extends through the entire pinched seal 4 and is enveloped by the second coating 6 in the pinched seal.

TABLE 1

| | (1), (6) | (5) | (1') |
|---|---|---|---|
| $SiO_2$ | 63.3 | 5.6 | 5.7 |
| $B_2O_3$ | 0.8 | 17.2 | 18.5 |
| $Al_2O_3$ | 4.7 | 8.8 | 9.2 |
| $Na_2O$ | 17.1 | | |
| $K_2O$ | 0.7 | 0.16 | |
| MgO | 3.1 | 5.1 | 5.0 |
| CaO | 4.7 | 10.3 | 10.0 |
| BaO | 5.2 | 50.4 | 50.4 |
| SrO | | 0.9 | 1.1 |
| $ZrO_2$ | | 1.5 | |
| $SO_3$ | 0.07 | | |
| remainder | 0.33 | 0.04 | 0.1 |

(1) In Table 1, the legend indicates borate glass on a coating of the inner surface of the discharge vessel In the lamp shown, each electrode 2 has two current conductors 3, for example made of CrNiFe, each with an individual first 5 and an individual second coating 6. The discharge vessel 1 is made of lime glass and has a layer of borate glass at its inner surface in order to make the discharge vessel resistant to sodium. The outer bulb has an IR reflection filter, for example of tin-doped indium oxide, at its innner surface.

The lamp in the drawing has a first coating of borate glass which extends throughout the relevant pinched seal from inside the discharge vessel. It is favourable for the coating to extend to outside the discharge vessel so as to have manufacturing tolerances available. The second coating of lime glass may be made, for example, of the same glass as the discharge vessel. The presence of this coating is nevertheless visible, inter alia because it projects from the pinched seal.

The lamp of the type shown continued to burn after 9000 hours at a 125 kHz high-frequency supply without cracks becoming observable. Among a group of 106 lamps of the known type, however, lamps with cracks were found after 2000 hours already upon operation under identical circumstances. One fourth of the number of lamps exhibited cracks after 5000 hours. The compositions of the glasses used are given in % by weight in Table 1.

We claim:

1. A low-pressure sodium discharge lamp, comprising:

a lime glass discharge vessel which is sealed in a vacuumtight manner and has a filling comprising sodium and rare gas;

electrodes arranged in the discharge vessel and each connected to at least one respective current conductor which issues to the exterior through a respective pinched seal, wherein the current conductors each have a first coating of borate glass which extends from the relevant pinched seal to inside the discharge vessel, and in contact with said coating a second, lime glass coating which extends to outside the discharge vessel; and an outer bulb which surrounds the discharge vessel, characterized in that the first coating extends through the entire pinched seal and is enveloped by the second coating in the pinched seal.

2. A low pressure sodium discharge lamp according to claim 1, wherein said outer envelope includes an IR reflection filter.

3. A low pressure sodium discharge lamp, comprising:

a) an outer envelope;

b) a discharge vessel within said outer envelope, said discharge vessel having a wall comprised of lime glass and enclosing a discharge space, said discharge vessel having a seal sealing said discharge vessel in a gas-tight manner;

c) a discharge-sustaining filling comprising sodium within said discharge vessel;

d) means, including a discharge electrode arranged within said discharge vessel, for maintaining a discharge within said discharge vessel during lamp operation; and e) a current conductor extending from outside said discharge vessel through said seal to said discharge electrode, said discharge vessel further including a first coating on said current conductor comprising borate glass, a second coating comprising lime glass on said first coating and in contact with said glass of said discharge vessel, said first and second coatings each extending completely through said seal, and said lime glass of said second coating and of said discharge vessel wall having coefficients of thermal expansion which are substantially equal.

4. A low pressure sodium discharge lamp according to claim 3, wherein the lime glass of said second coating has the identical composition to that of said discharge vessel wall.

5. A low pressure discharge lamp according to claim 4, wherein said discharge vessel has an inner surface with a coating of borate glass, said coating of borate glass covering said second coating and extending to said first coating of borate glass.

6. A low pressure discharge lamp according to claim 5, further including a second said current conductor connected to said discharge electrode and surrounded by a respective said first and second coating.

7. A low pressure discharge lamp according to claim 3, further including a second said current conductor connected to said discharge electrode and surrounded by a respective said first and second coating.

8. A low pressure sodium discharge lamp adapted for high frequency operation, comprising:

a) a glass discharge vessel enclosing a discharge space, said discharge vessel having a seal sealing said discharge vessel in a gas-tight manner;

c) a discharge-sustaining filling comprising sodium within said discharge vessel;

d) means, including a discharge electrode arranged within said discharge vessel, for maintaining a discharge within said discharge vessel during lamp operation; and e) a current conductor extending from outside said discharge vessel through said seal to said discharge electrode, said current conductor having an outer surface and mainly carrying current near said outer surface during high frequency operation of said lamp;

said discharge vessel further including a first coating on said current conductor comprising borate glass and a second glass coating on said first coating, said first and second coatings each extending completely through said seal, and said glass of said second coating and said glass of said discharge vessel having coefficients of thermal expansion which are substantially equal.

9. A low pressure sodium discharge lamp according to claim 8, wherein the glass of said second coating has the identical composition to said glass of said discharge vessel.

10. A low pressure sodium discharge lamp according to claim 9, wherein the glass of said second coating and said glass of said discharge vessel are a lime glass.

11. A low pressure sodium discharge lamp according to claim 8, wherein the glass of said second coating and said glass of said discharge vessel are a lime glass.

* * * * *